US008015652B2

(12) United States Patent
Chiang

(10) Patent No.: US 8,015,652 B2
(45) **Date of Patent: *Sep. 13, 2011**

(54) MOP WRINGER WITH HANDLE BEING SHAPED IN CONFORMITY TO A RECESSED HALF OF TOP EDGE

(75) Inventor: Hsiao-Hung Chiang, Taipei (TW)

(73) Assignee: Young Fone Co., Ltd., New Taipei (TW)

( * ) Notice: Subject to any disclaimer, the term of this patent is extended or adjusted under 35 U.S.C. 154(b) by 325 days.

This patent is subject to a terminal disclaimer.

(21) Appl. No.: 12/399,983

(22) Filed: Mar. 9, 2009

(65) Prior Publication Data

US 2010/0223749 A1 Sep. 9, 2010

(51) Int. Cl.
*A47L 13/00* (2006.01)
*A47L 13/58* (2006.01)

(52) U.S. Cl. ..... 15/119.1; 15/260

(58) Field of Classification Search ..... 15/119.1; 16/110.1

See application file for complete search history.

(56) References Cited

U.S. PATENT DOCUMENTS

| | | | | |
|---|---|---|---|---|
| D208,276 | S * | 8/1967 | Moore | D32/53 |
| D320,295 | S * | 9/1991 | Delmerico | D32/53 |
| 6,115,877 | A * | 9/2000 | Morad et al. | 15/261 |
| 2010/0077558 | A1 * | 4/2010 | Chiang | 15/119.1 |

* cited by examiner

*Primary Examiner* — Monica Carter
*Assistant Examiner* — Stephanie Newton

(57) ABSTRACT

A mop wringer is provided and has a handle being shaped in conformity to a recessed half of a top edge of the mop wringer so that a flat top edge can be formed when the handle is rested upon the recessed half of the top edge. A plurality of mop wringers can be stably stacked so as to facilitate both storage and transport.

1 Claim, 6 Drawing Sheets

MOP WRINGER WITH HANDLE BEING SHAPED IN CONFORMITY TO A RECESSED HALF OF TOP EDGE

BACKGROUND OF THE INVENTION

1. Field of Invention

The invention relates to mop wringers and more particularly to such a mop wringer having a handle being shaped in conformity to a recessed half of a top edge of the mop wringer so that a flat top edge can be formed when the handle is rested upon the recessed half of the top edge and thus a plurality of mop wringers can be stably stacked so as to facilitate both storage and transport.

2. Description of Related Art

A conventional mop wringer is shown in FIG. 6 and comprises a pail 6 having an open space 61 for containing squeezed water, a surface cavity 62, and a pivotal handle 63 adapted to rested upon either half of a top edge of the pail 6; a foot-operated mop wringing mechanism 7 mounted at the cavity 62; and a rotatable mop receptacle 8 in the space 61 being mounted on the mop wringing mechanism 7.

However, the well known mop wringer suffers from a disadvantage. In detail, the handle 63 is adapted to rest upon the pail's top edge having an outward extending flange portion by pivoting. As a result, an uneven surface on the pail's top edge is formed. This has a disadvantage of making a plurality of stacked mop wringers unstable in storage and the stacked mop wringers may tend to loosen during mop wringer.

There have been numerous suggestions in prior patents for mop wringer. For example, U.S. Pat. No. 5,349,720 discloses a mop wringer. But a mop wringer with a handle being shaped in conformity to a recessed half of a top edge thereof has not been disclosed as far as the inventor is aware.

SUMMARY OF THE INVENTION

It is therefore one object of the invention to provide a mop wringer having a handle being shaped in conformity to a recessed half of a top edge of the mop wringer so that a flat top edge can be formed when the handle is rested upon the recessed half of the top edge and thus a plurality of mop wringers can be stably stacked so as to facilitate both storage and transport.

The above and other objects, features and advantages of the invention will become apparent from the following detailed description taken with the accompanying drawings.

DETAILED DESCRIPTION OF THE INVENTION

Figure 1:
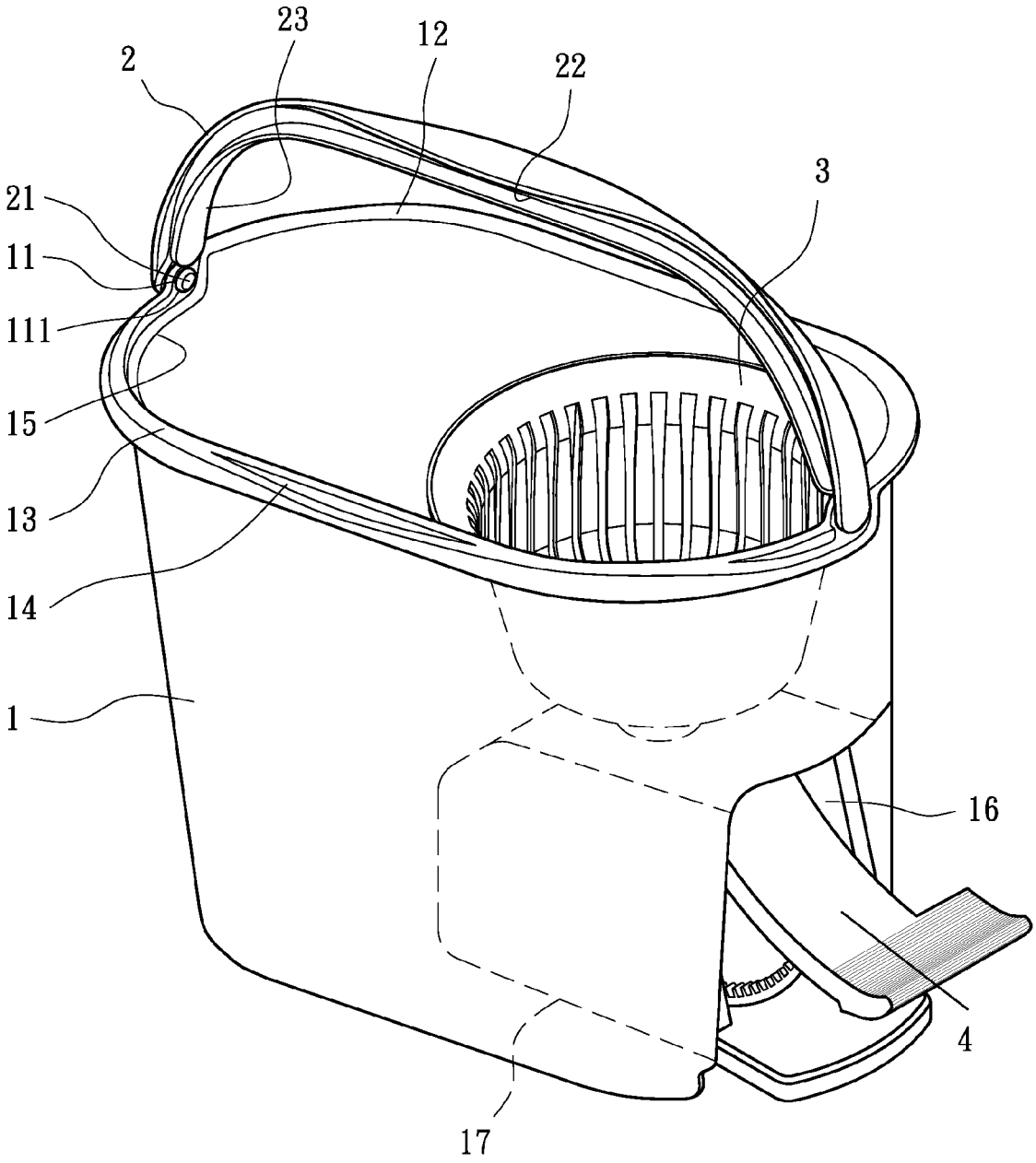
FIG. 1 is a perspective view of a preferred embodiment of mop wringer according to the invention.
Figure 2:
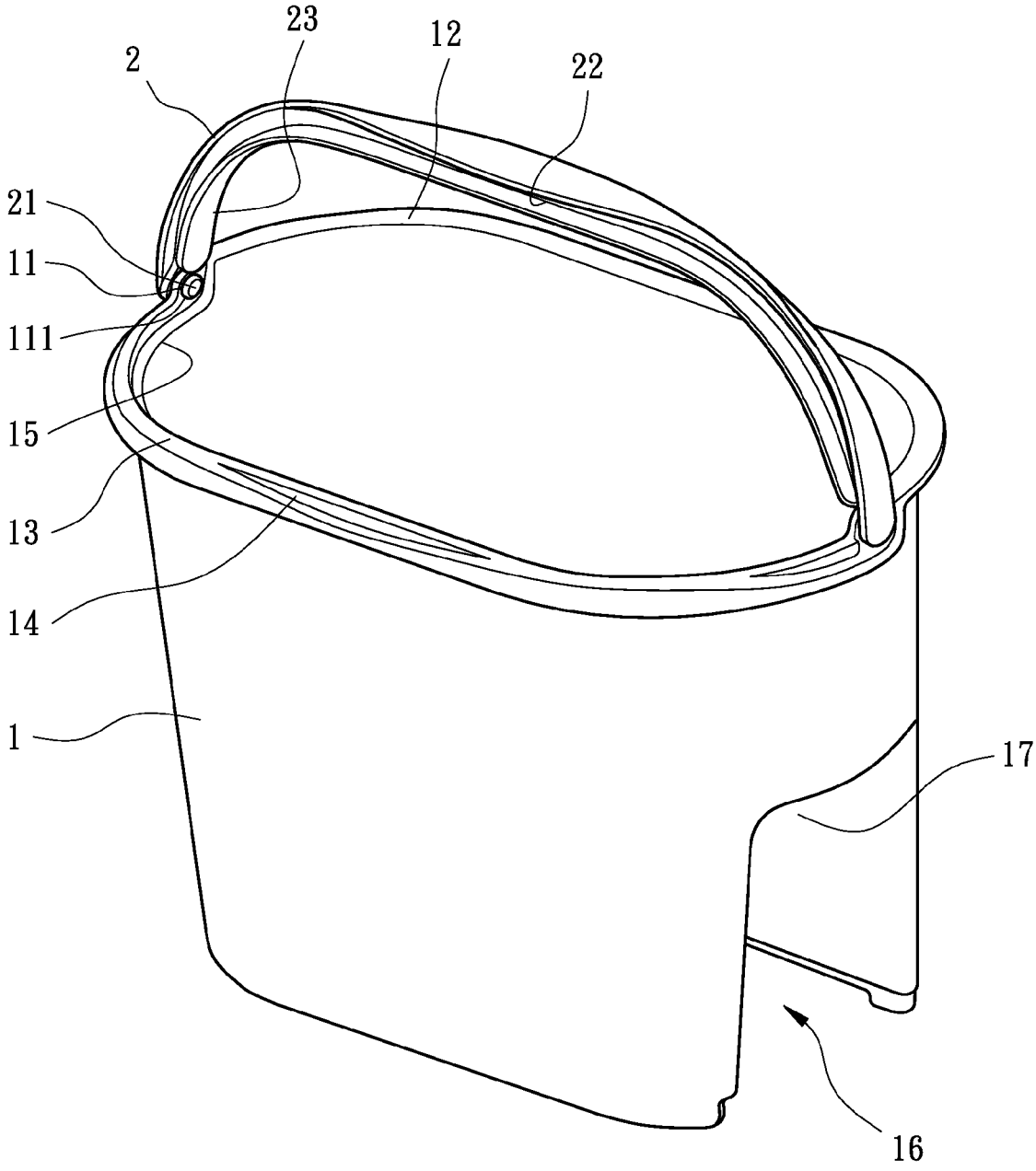
FIG. 2 is a view similar to FIG. 1 with both the mop wringing mechanism and a rotatable mop receptacle removed.
Figure 3:
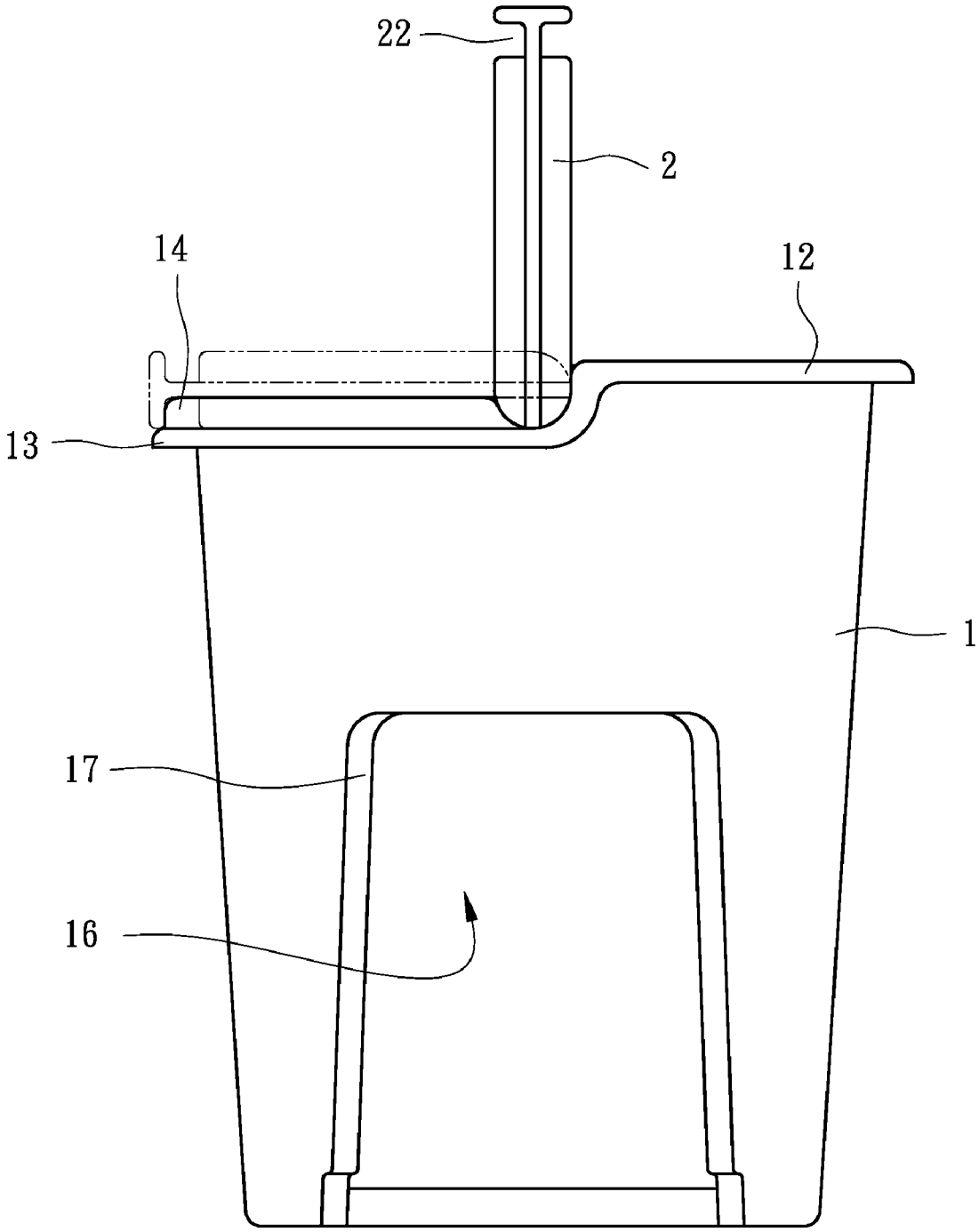
FIG. 3 is a front view of FIG. 2 with the handle being rested upon a recessed half of a top edge of the mop wringer shown in phantom.
Figure 4:
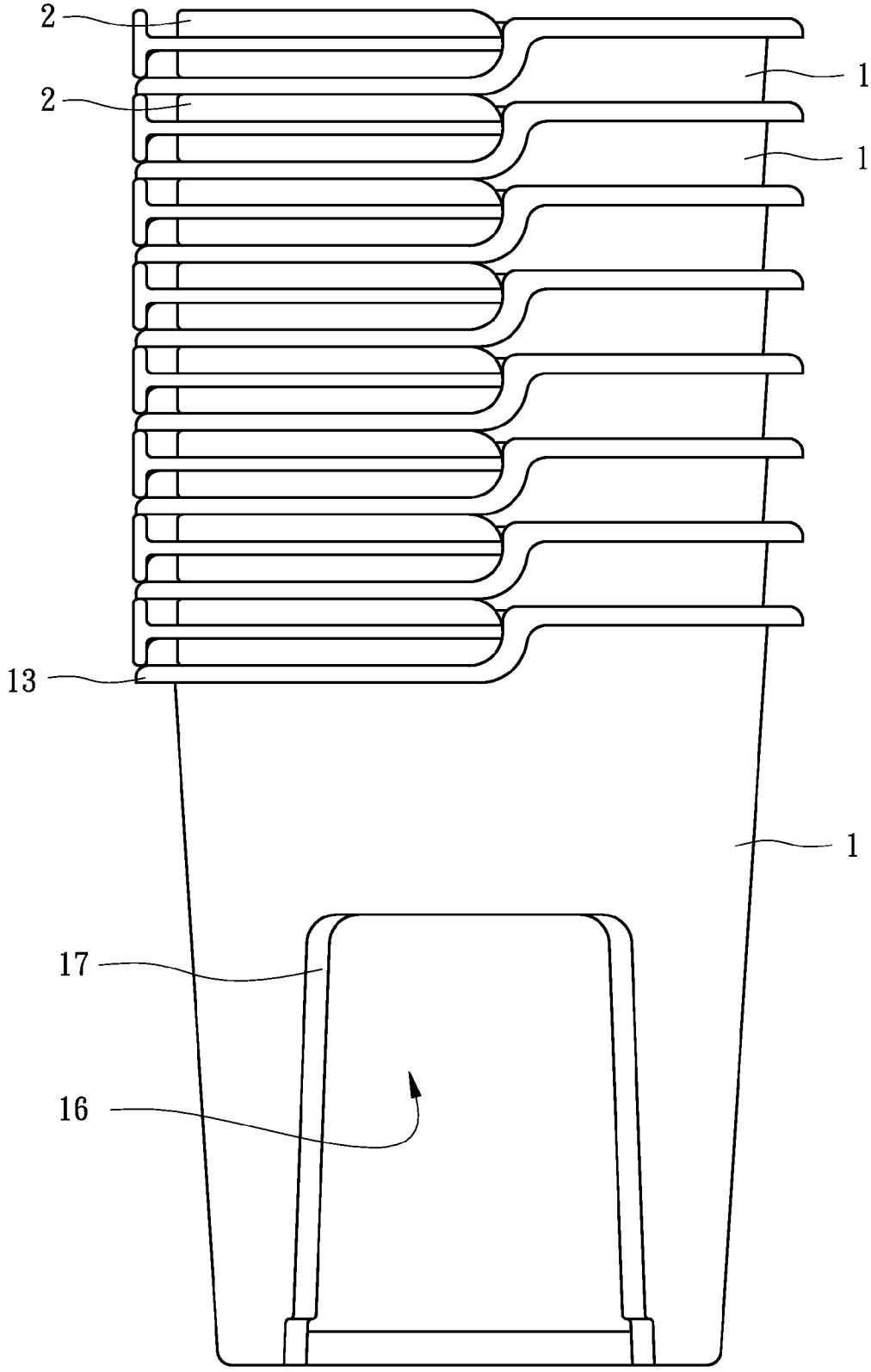
FIG. 4 is a front view of a plurality of stacked mop wringers.
Figure 5:
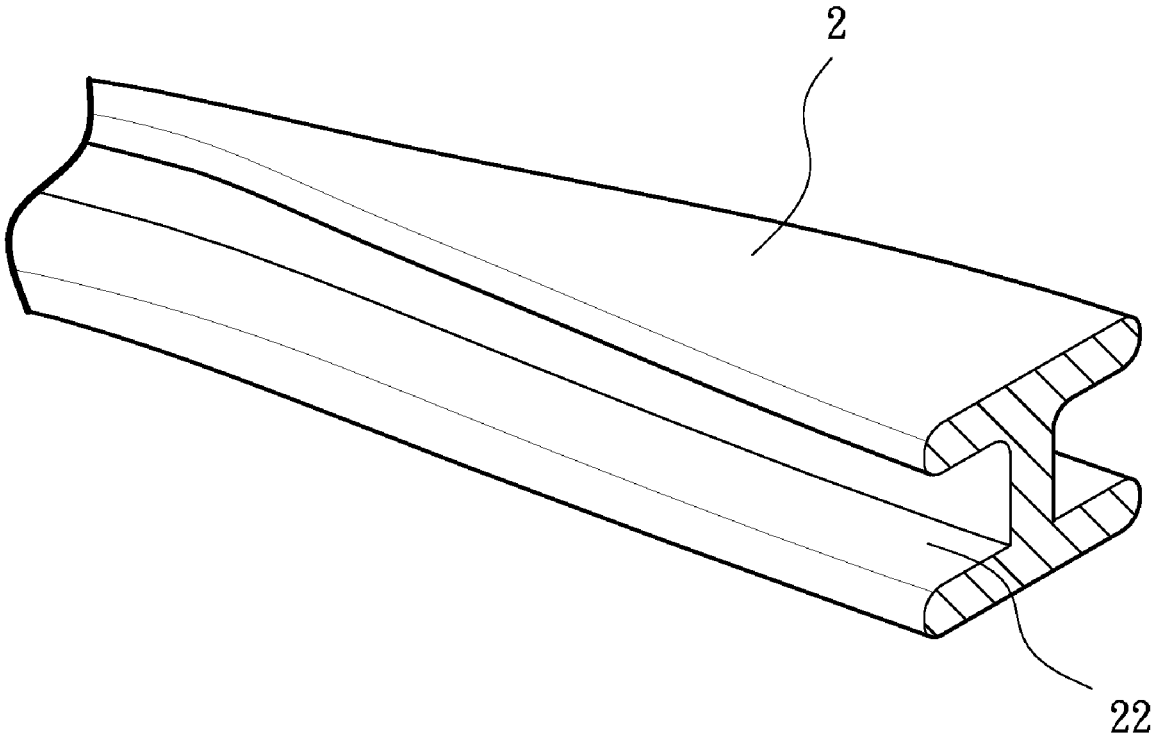
FIG. 5 is a longitudinal sectional view of an intermediate locking portion of the handle.
Figure 6:
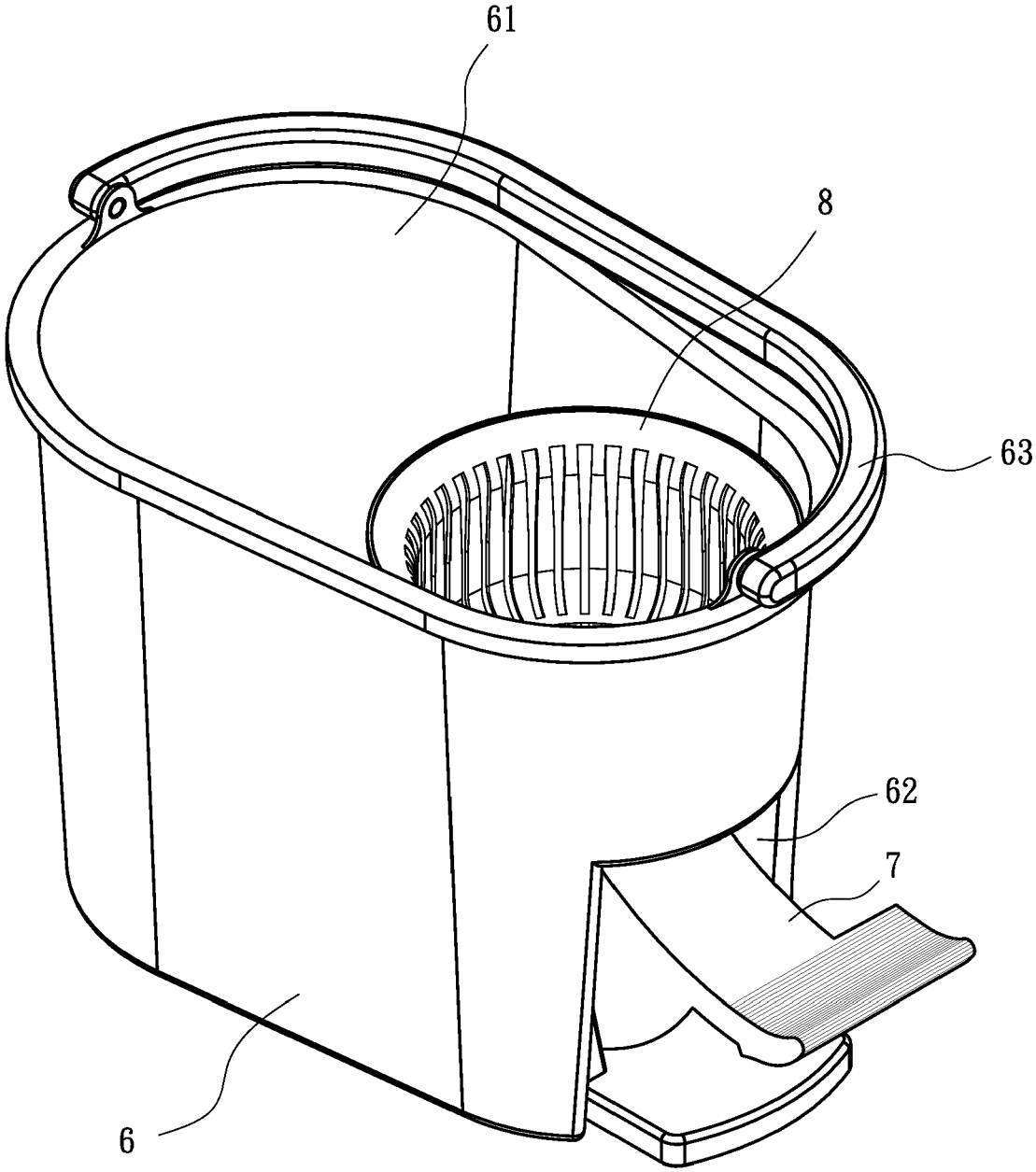
FIG. 6(Prior Art)
FIG. 6 is a perspective view of a conventional mop wringer.

Referring to FIGS. 1 to 5, a mop wringer in accordance with a preferred embodiment of the invention comprises the following components as discussed in detail below.

A pail 1 has an open space (not numbered) for containing squeezed water, a surface cavity 16, a top edge (not numbered) having an outward extending flange portion, the top edge being comprised of a recessed half 13 having an intermediate recess 14, and a raised half 12, and two shoulders 11 either formed between either joining portion of the recessed half 13 and the raised half 12, either shoulder 11 having a through hole 111.

An inverted U-shaped handle 2 comprises two pivot pins 21 on both ends and an intermediate locking portion 22 of I-shaped section. The pivot pin 21 is pivotably mounted in the through hole 111.

A foot-operated mop wringing mechanism 4 is mounted at the cavity 16. A rotatable mop receptacle 3 in the pail 1 is mounted on the mop wringing mechanism 1.

The locking portion 22 is shaped in conformity to the recess 14 and is adapted to lockingly engage therewith by snapping when the handle 2 is rested upon the recessed half 13. At this position, an inner surface 23 of the handle 2 is adapted to engage with and is about flush with an inner wall 15 of the pail 1. Hence, a flat top edge of the pail 1 is formed. Further, a plurality of mop wringers can be stably stacked. Furthermore, the cavity 16 has an inner wall 17 of reduced size. It is envisaged by the invention that both storage and transport of mop wringers can be facilitated.

While the invention herein disclosed has been described by means of specific embodiments, numerous modifications and variations could be made thereto by those skilled in the art without departing from the scope and spirit of the invention set forth in the claims.

What is claimed is:

1. A mop wringer comprising:

a pail for containing squeezed water and comprising a surface cavity and a flanged top edge comprising a recessed half having an intermediate recess, and a raised half;

a handle having an intermediate locking portion, either end of the handle being pivotably secured to one of two joining portions of the recessed half and the raised half;

a foot-operated mop wringing mechanism mounted at the cavity; and a rotatable mop receptacle in the pail being mounted on the mop wringing mechanism, wherein the locking portion is shaped in conformity to the recess and lockingly engages therewith when the handle is rested upon the recessed half so as to form a substantially flat top surface on the top edge.

* * * * *